US006752326B2

(12) United States Patent
Hirota et al.

(10) Patent No.: US 6,752,326 B2
(45) Date of Patent: Jun. 22, 2004

(54) LIQUID DROPLET EJECTION APPARATUS AND LIQUID DROPLET EJECTING METHOD

(75) Inventors: Toshikazu Hirota, Owariasahi (JP); Takao Ohnishi, Nishikasugai-Gun (JP)

(73) Assignee: NGK Insulators, Ltd., Nagoya (JP)

( * ) Notice: Subject to any disclaimer, the term of this patent is extended or adjusted under 35 U.S.C. 154(b) by 221 days.

(21) Appl. No.: 09/884,457

(22) Filed: Jun. 19, 2001

(65) Prior Publication Data

US 2002/0050533 A1 May 2, 2002

(30) Foreign Application Priority Data

Jun. 20, 2000 (JP) ..... 2000-185494

(51) Int. Cl.[7] ..... B05B 1/08
(52) U.S. Cl. ..... 239/102.2; 239/102.1
(58) Field of Search ..... 239/102.1, 102.2

(56) References Cited

U.S. PATENT DOCUMENTS

| | | | | |
|---|---|---|---|---|
| 4,067,496 A | * | 1/1978 | Martin | 239/102.2 |
| 4,907,748 A | | 3/1990 | Gardner et al. | |
| 5,248,087 A | * | 9/1993 | Dressler | 239/102.2 |
| 5,437,255 A | | 8/1995 | Sadley et al. | |
| 5,823,428 A | * | 10/1998 | Humberstone et al. | 239/4 |
| 6,347,441 B1 | * | 2/2002 | Yun et al. | 29/25.35 |

FOREIGN PATENT DOCUMENTS

| | | |
|---|---|---|
| EP | 1 093 837 A1 | 4/2001 |
| EP | 1 093 857 A1 | 4/2001 |
| JP | 54-090416 | 7/1979 |
| JP | 4-24657 | 2/1992 |
| JP | 04-134176 | 5/1992 |
| JP | 6-55739 | 3/1994 |
| JP | 2000-52552 | 2/2000 |

* cited by examiner

*Primary Examiner*—Christopher S. Kim
(74) *Attorney, Agent, or Firm*—Burr & Brown

(57) ABSTRACT

The liquid droplet ejection apparatus includes a liquid supply path, a plurality of mutually independent pressurizing chambers, a plurality of liquid introduction bores for establishing communication between the corresponding pressurizing chambers and the liquid supply path, and a plurality of ejection nozzles for establishing communication between the corresponding pressurizing chambers and the exterior of the liquid droplet ejection apparatus. An ejection bore formed at the end portion of the ejection nozzle has a hollow cylindrical form and the inside diameter thereof increases toward an ejection opening. When a potential difference is applied between two electrodes of a piezoelectric/electrostrictive element, a ceramic sheet forming the upper wall of the pressurizing chamber deforms to thereby cause a change of the volume of the pressurizing chamber. Thus, liquid pressure within the pressurizing chamber increases to thereby cause simultaneous ejection of a plurality of liquid droplets from the ejection opening.

4 Claims, 7 Drawing Sheets

LIQUID DROPLET EJECTION APPARATUS AND LIQUID DROPLET EJECTING METHOD

BACKGROUND OF THE INVENTION

1. Field of the Invention

The present invention relates to a liquid droplet ejection apparatus for ejecting droplets of liquid, such as liquid material or fluid, from an ejection opening through pressurization of the liquid within a pressurizing chamber.

2. Description of the Related Art

The liquid droplet ejection apparatus of this type includes a pressurizing chamber into which liquid is introduced via a liquid introduction bore, an ejection nozzle communicating with the pressurizing chamber, and pressurizing means, such as a piezoelectric/electrostrictive element, for changing the volume of the pressurizing chamber. The apparatus pressurizes liquid contained in the pressurizing chamber through change in the volume of the pressurizing chamber to thereby eject the liquid in the form of droplets from an ejection opening of the ejection nozzle. Such a liquid droplet ejection apparatus is used in, for example, a color printer.

However, since a conventional liquid droplet ejection apparatus is intended to eject merely a single droplet of liquid by a single operation of pressurization, the diameter of a liquid droplet is relatively large. Thus, the conventional apparatus cannot be used in mechanical equipment requiring mistlike fuel or the like.

SUMMARY OF THE INVENTION

An object of the present invention is to provide a liquid droplet ejection apparatus capable of ejecting liquid in a mistlike form.

To achieve the object, the present invention provides a liquid droplet ejection apparatus comprising a pressurizing chamber communicating with a liquid supply path via a liquid introduction bore; an ejection nozzle connected to the pressurizing chamber; and a piezoelectric/electrostrictive element for changing a volume of the pressurizing chamber so as to pressurize liquid introduced into the pressurizing chamber via the liquid introduction bore to thereby eject the liquid in a form of liquid droplets from a circular ejection opening of the ejection nozzle, wherein a diameter of a largest liquid droplet among the liquid droplets ejected is not greater than a diameter of the ejection opening.

Also, the present invention provides a similar liquid droplet ejection apparatus configured such that a plurality of liquid droplets are simultaneously ejected from the ejection opening by means of a single operation of pressurization.

Furthermore, the present invention provides a similar liquid droplet ejection apparatus configured such that a plurality of liquid droplets ejected from the ejection opening by means of a single operation of pressurization simultaneously reach an imaginary plane defined in a manner such that all points on the plane maintain an equal distance to the ejection opening.

These liquid droplet ejection apparatuses can be used in mechanical equipment requiring mistlike fuel or the like (e.g., a gasoline-injection-type internal combustion engine) and eject (inject) liquid through effective utilization of a piezoelectric/electrostrictive element.

Preferably, any one of the liquid droplet ejection apparatuses described above is configured such that each of the liquid introduction bore and an ejection-side end portion of the ejection nozzle assumes a hollow, substantially cylindrical form, and a bottom face of the cylinder forming the ejection-side end portion of the ejection nozzle serves as the ejection opening; the ratio of the diameter of the liquid introduction bore to the diameter of the ejection opening is 0.6 to 1.6; the ratio of the diameter of the ejection opening to the height of the hollow cylinder forming the ejection-side end portion is 0.2 to 4; and the rate of change (per unit time) in the ratio of the amount of change in the volume of the pressurizing chamber to the sum of the volume of the ejection nozzle and the volume of the pressurizing chamber is 6 ppm/$\mu$s to 40 ppm/$\mu$s.

The ratio of the diameter d0 of the liquid introduction bore to the diameter d1 of the ejection opening (d0/d1) is 0.6 to 1.6 for the following reason. When the ratio (d0/d1) is less than 0.6, the amount of liquid to be introduced into the pressurizing chamber via the liquid introduction bore becomes small in relation to the amount of liquid to be ejected from the ejection opening, causing an ejection defect. When the ratio (d0/d1) is in excess of 1.6, during pressurization, a large amount of liquid flows back into the liquid supply path from the pressurizing chamber via the liquid introduction bore, resulting in a failure to eject liquid from the ejection opening.

The ratio of the diameter d1 of the ejection opening (i.e., the diameter d1 of the bottom face of the hollow cylinder) to the height h1 of the hollow cylinder formed at the ejection-side end portion (d1/h1) is 0.2 to 4 for the following reason. When the ratio (d1/h1) is not greater than 4, during ejection, contact resistance between liquid and the inside wall surface of the ejection-side end portion becomes relatively large, so that vibration remaining, on liquid surface, immediately after ejection settles promptly, thereby preventing air (a bubble) from being caught in the ejection nozzle. As a result, entry of a bubble into the pressurizing chamber from the ejection nozzle can be prevented, thereby enhancing ejection stability. When the ratio (d1/h1) is less than 0.2, during ejection, contact resistance between liquid and the inside wall surface of the ejection-side end portion becomes excessively large. As a result, the force of ejection becomes insufficient, resulting in disabled ejection.

The rate of change (per unit time) R in the ratio of the amount of change $\Delta V$ in the volume of the pressurizing chamber to the sum of the volume $\Delta n$ of the ejection nozzle and the volume Vk of the pressurizing chamber ($\Delta V/(Vn+Vk)$) is 6 ppm/$\mu$s to 40 ppm/$\mu$s for the following reason. The greater the rate of change R, the smaller liquid droplets become. However, when the rate of change R is in excess of 40 ppm/$\mu$s, ejection becomes unstable. When the rate of change R is less than 6 ppm/$\mu$s, droplets to be ejected become granular. As a result, an object that a plurality of liquid droplets are ejected by means of a single operation of pressurization cannot be attained.

Preferably, any one of the liquid droplet ejection apparatuses described above is configured such that an ejection-side end portion of the ejection nozzle assumes a hollow, substantially cylindrical form and is formed such that a bottom face of the cylinder serves as the ejection opening; and an inside diameter of the cylinder increases toward the ejection opening. In this case, preferably, a value obtained by dividing, by the height h1 of the cylinder, the difference between the diameter d1 of the bottom face of the cylinder and the diameter d2 of the top face of the cylinder serving as an opening located on the side of the pressurizing chamber ((d1−d2)/h1) is 0.05 to 0.7.

Through employment of the geometric features mentioned above, the liquid is ejected in a mistlike form for the following reason. Conceivably, during ejection, the liquid is subjected to not only a force imposed along the axial direction of the hollow cylinder (i.e., along the direction perpendicular to a plane serving as the ejection opening), but also a force imposed along a direction perpendicular to the axial direction and exerted from the inside wall surface of the hollow cylinder; thus, the liquid becomes unlikely to assume a large granular form.

Also, any one of the liquid droplet ejection apparatuses described above is preferably configured such that the ejection-side end portion of the ejection nozzle comprises a first ejection bore formed in a thin-plate member and assuming a hollow, substantially cylindrical form having a top face located on the side of the pressurizing chamber and a bottom face located on the side of the ejection opening; and a second ejection bore assuming a hollow, substantially cylindrical form and formed in a liquid-repellent layer formed on the surface of the thin-plate member located on the side of the ejection opening, a top face of the hollow cylinder forming an opening connected to the bottom face of the first ejection bore, a bottom face of the hollow cylinder forming the ejection opening of the ejection nozzle. The inside diameter of the second ejection bore increases toward the ejection opening. In this case, preferably, a value obtained by dividing, by the height of the second ejection bore, the difference between the diameter of the ejection opening of the second ejection bore and the diameter of the opening of the second ejection bore connected to the first ejection bore is 0.5 to 2.0.

The liquid-repellent layer is provided in order to prevent adhesion of liquid droplets to an area around the ejection opening during ejection. When the liquid-repellent layer is provided, the liquid-repellent layer substantially serves as the end portion of the ejection nozzle. Accordingly, when, as mentioned above, the hollow, substantially cylindrical second ejection bore formed in the liquid-repellent layer is configured such that the inside diameter thereof increases toward the ejection opening, the liquid is subjected to not only a force imposed along the axial direction of the second ejection bore (hollow cylinder), but also a force imposed along a direction perpendicular to the axial direction; thus, the liquid becomes unlikely to assume a granular form. As a result, the liquid is ejected in a mistlike form.

Further, preferably, in the above-described liquid droplet ejection apparatus having the first and second ejection bores, the inside diameter of the first ejection bore decreases toward the second ejection bore.

Through employment of the geometric feature that the inside diameter of the first ejection bore decreases toward the second ejection bore, variation in liquid pressure within the pressurizing chamber immediately after ejection becomes unlikely to occur, thereby lowering the possibility of entry of a bubble into the pressurizing chamber from the ejection nozzle. As a result, ejection becomes stable.

Also, any one of the liquid droplet ejection apparatuses described above is preferably configured such that an ejection-side end portion of the ejection nozzle assumes a hollow, substantially cylindrical form and is formed such that a bottom face of the cylinder serves as the ejection opening; and a protrusion portion is formed on an inside wall surface of the ejection-side end portion. In this case, the ratio of the height of the protrusion portion to the diameter of the ejection opening preferably falls within the range of 0.03 to 0.17. Moreover, three to twelve protrusion portions are preferably formed along the inside wall surface of the ejection-side end portion.

The protrusion portions split a liquid droplet immediately before ejection, thereby facilitating ejection of liquid in a mistlike form.

Preferably, in any one of the liquid droplet ejection apparatuses described above, the pressurizing chamber and the ejection nozzle are integrally formed of zirconia ceramics.

By virtue of characteristics of zirconia ceramics, a liquid droplet ejection apparatus having high durability against frequent deformation can be readily manufactured.

Embodiments of the present invention will next be described with reference to drawings. Herein, the term "piezoelectric/electrostrictive" means piezoelectric and/or electrostrictive. The piezoelectric/electrostrictive element is widely known as an element characterized by extending primarily in a direction parallel to an externally applied electric field and contracting in a direction perpendicular to the electric field and adapted to convert electrical energy to mechanical energy and vice versa. A piezoelectric element is characterized by exhibiting coercive electric field (external electric field as observed upon inversion of polarization) of relatively high intensity. An electrostrictive element is characterized by exhibiting coercive electric field of very low intensity.

DESCRIPTION OF THE PREFERRED EMBODIMENTS

First Embodiment

Figure 1A:
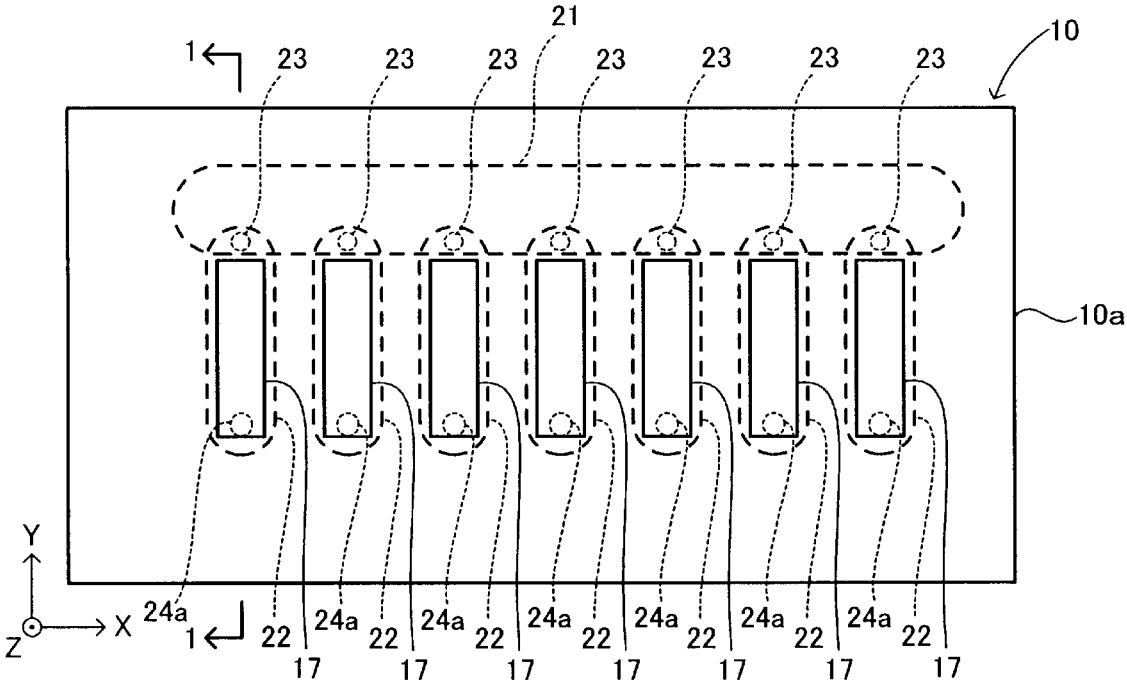
FIG. 1A is a plan view of a liquid droplet ejection apparatus according to a first embodiment of the present invention.
Figure 1B:
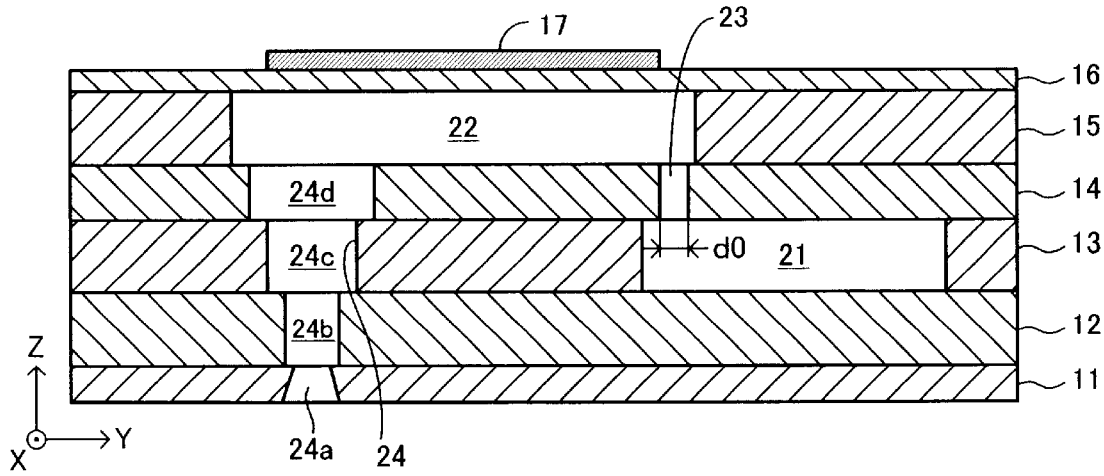
FIG. 1B is a sectional view of the liquid droplet ejection apparatus taken along line 1—1 of FIG. 1A.

FIG. 1A is a plan view of a liquid droplet ejection apparatus 10 according to a first embodiment of the present invention. FIG. 1B is a sectional view of the liquid droplet ejection apparatus 10 taken along line 1—1 of FIG. 1A. The liquid droplet ejection apparatus 10 is formed such that a plurality of ceramic thin-plate members (hereinafter called "ceramic sheets") 11–16 are sequentially stacked and press-bonded. The liquid droplet ejection apparatus 10 includes a body 10*a* assuming substantially the form of a rectangular parallelepiped whose sides extend in parallel with the corresponding X, Y, and Z axes of a rectangular coordinate system, and a piezoelectric/electrostrictive element 17 bonded on an outer surface of the ceramic sheet 16.

The liquid droplet ejection apparatus 10 includes a liquid supply path 21, a plurality of mutually independent pressurizing chambers 22, a plurality of liquid introduction bores 23 for establishing communication between the corresponding pressurizing chambers 22 and the liquid supply path 21, and a plurality of ejection nozzles 24 for establishing communication between the corresponding pressurizing chambers 22 and the exterior of the liquid droplet ejection apparatus 10.

The liquid supply path 21 is a space defined by the side wall surface of an oval cutout portion formed in the ceramic sheet 13 and whose major and minor axes extend along the X axis and the Y axis, respectively, the upper surface of the ceramic sheet 12, and the lower surface of the ceramic sheet 14. The liquid supply path 21 communicates with an unillustrated liquid source to thereby be always filled with liquid to be ejected.

The plurality of pressurizing chambers 22 are spaces each of which is defined by the side wall surface of an oval cutout portion formed in the ceramic sheet 15 and whose major and minor axes extend along the Y axis and the X axis, respectively, the upper surface of the ceramic sheet 14, and the lower surface of the ceramic sheet 16. An end portion of each pressurizing chamber 22 in relation to the positive direction of the Y axis extends in such a manner as to project above the liquid supply path 21, so that the pressurizing chamber 22 communicates, at the end portion, with the liquid supply path 21 through the corresponding hollow cylindrical liquid introduction bore 23 of diameter d0 formed in the ceramic sheet 14. Each piezoelectric/electrostrictive element 17 is slightly smaller than the corresponding pressurizing chamber 22 as viewed from above and is bonded on the upper surface of the ceramic sheet 16 in such a manner as to be disposed within the pressurizing chamber 22 as viewed from above. Each piezoelectric/electrostrictive element 17 operates according to the potential difference between unillustrated electrodes disposed on the upper and lower surfaces of the piezoelectric/electrostrictive element 17, thereby deforming the ceramic sheet 16 (upper wall of the pressurizing chamber 22) and thus changing the volume of the pressurizing chamber 22 by $\Delta V$.

The plurality of ejection nozzles 24 are each formed through coaxial arrangement hollow, substantially cylindrical (i.e., circular as viewed from above) through-bores 24*a*–24*d* formed in the ceramic sheets 11–14, respectively. The through-bore 24*d* communicates with the pressurizing chamber 22 at the lower surface of an end portion of the pressurizing chamber 22 in relation to the negative direction of the Y axis (i.e., an end portion opposite an end portion at which the liquid introduction bore 23 is located). The through-bore 24*d* is the largest in diameter among the through-bores 24*a*–24*d*. The diameter of the through-bore 24*c* is greater than that of the through-bore 24*b*. The diameter of the through-bore 24*b* is greater than that of the through-bore 24*a* (the maximum diameter of the through-bore 24*a*). The through-bore 24*a* serves as the end portion of the ejection nozzle (i.e., an ejection-side end portion). The bottom face of the hollow cylinder serves as an ejection opening for ejecting liquid droplets toward the exterior of the liquid droplet ejection apparatus 10. Accordingly, hereinafter the through-bore 24*a* is called the ejection bore 24*a*.

Figure 2A:
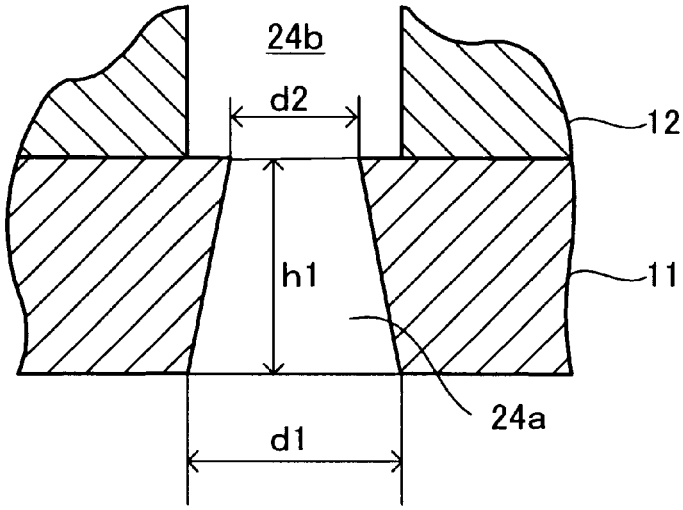
FIG. 2A is an enlarged sectional view of an ejection bore of the liquid droplet ejection apparatus shown in FIG. 1B.
Figure 2B:
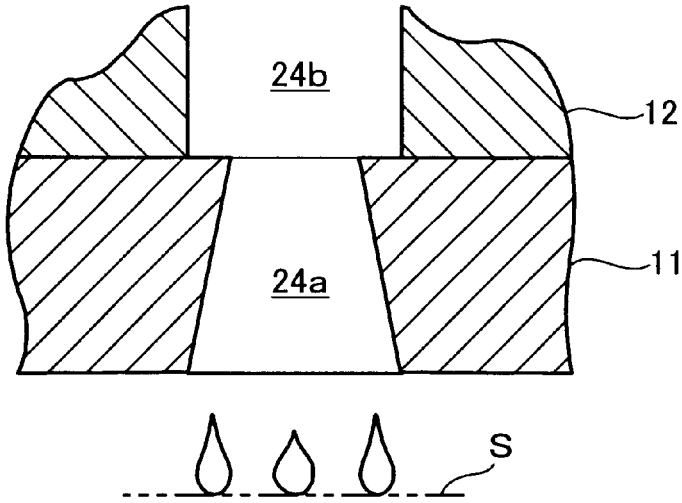
FIG. 2B is a view showing a state immediately after ejection of liquid droplets from the ejection bore shown in FIG. 2A.

As shown in the enlarged sectional views of FIGS. 2A and 2B, the ejection bore 24*a* assumes a hollow, substantially cylindrical form and is formed such that the inside diameter of the cylinder increases toward the ejection opening; i.e., the ejection bore 24*a* assumes the form of a truncated cone. In other words, d1 is greater than d2, where d1 is the diameter of the bottom face (i.e., the ejection opening) of the cylinder and d2 is the diameter of the top face (i.e., an opening connected to the through-bore 24*b* allocated on the side of the pressurizing chamber 22) of the cylinder.

Next, the operation of the liquid droplet ejection apparatus 10 will be described. When no potential difference is applied between the two electrodes of the piezoelectric/electrostrictive element 17, the liquid droplet ejection apparatus 10 maintains a state shown in FIG. 1B. At this time, the pressurizing chamber 22 and the ejection nozzle 24 are filled with liquid. Next, when a potential difference is applied between the two electrodes of the piezoelectric/electrostrictive element 17, the piezoelectric/electrostrictive element 17 attempts to contract in the X-Y plane. The force of contraction in the X-Y plane is transmitted to the upper surface of the ceramic sheet 16 on which the piezoelectric/electrostrictive element 17 is bonded. Thus, the ceramic sheet 16 deforms in such a manner as to decrease the volume of the pressurizing chamber 22 by $\Delta V$. Accordingly, liquid contained in the pressurizing chamber 22 is pressurized and is thus ejected, in the form of a droplet, from the ejection opening of the ejection bore 24*a*.

Next, when the potential difference applied to the two electrodes of the piezoelectric/electrostrictive element 17 is canceled, the deformation of the ceramic sheet 16 induced by activation of the piezoelectric/electrostrictive element 17 is undone; thus, the volume of the pressurizing chamber 22 is restored. At this time, since the pressure of liquid contained in the pressurizing chamber 22 decreases (drops), liquid contained in the liquid supply path 21 is sucked (introduced) into the pressurizing chamber 22 via the liquid introduction bore 23. The action described above is repeated to thereby continuously eject liquid droplets.

The above-described ejection of liquid droplets will be described in detail. As shown in FIG. 2B, as a result of a single operation of pressurization effected by the piezoelectric/electrostrictive element 17, a plurality of liquid droplets are simultaneously ejected from the ejection opening. The diameter of the largest liquid droplet among the ejected liquid droplets is not greater than the diameter d1 of the ejection opening. These liquid droplets simultaneously reach an imaginary plane S formed in such a manner as to maintain an equal distance to the ejection opening.

A single operation of pressurization causes simultaneous ejection of a plurality of liquid droplets for the following reason. Conceivably, since the inside diameter of the hollow cylindrical ejection bore 24*a* increases toward the ejection opening, pressurized liquid to be ejected is subjected to not only a force imposed along the axial direction of the cylinder (i.e., along the direction perpendicular to the ejection opening), but also a force imposed along a direction perpendicular to the axial direction of the cylinder and exerted from the inside wall surface of the hollow cylindrical ejection bore 24*a*; thus, the liquid becomes unlikely to assume a large granular form.

In this case, in order to simultaneously eject a plurality of liquid droplets by means of a single operation of pressurization, it is preferable that the following requirements (1)–(4) are satisfied.

(1) The ratio of the diameter d0 of the liquid introduction bore 23 to the diameter d1 of the ejection opening (the diameter d1 of the bottom face of the hollow cylinder forming the ejection bore 24*a*) (d0/d1) must be 0.6 to 1.6.

When the ratio (d0/d1) is excessively small, resistance associated with introduction of liquid from the liquid supply path 21 to the pressurizing chamber 22 via the liquid introduction bore 23 becomes excessively large. Thus, the amount of liquid introduced into the pressurizing chamber 22 from the liquid supply path 21 becomes insufficient in relation to the amount of liquid ejected from the pressurizing chamber 22 via the ejection nozzle 24. As a result, a bubble enters the pressurizing chamber 22 through the ejection nozzle 24. The presence of the bubble disables ejection of a liquid droplet. When the ratio (d0/d1) is excessively large, during pressurization, a large amount of liquid flows back into the liquid supply path 21 from the pressurizing chamber 22 via the liquid introduction bore 23, resulting in a failure to eject liquid from the ejection opening of the ejection bore 24*a*. The present inventors studied the ratio (d0/d1) and found that a ratio (d0/d1) of 0.6–1.6 is preferred.

(2) The ratio of the diameter d1 of the bottom face of the hollow cylinder to the height h1 of the hollow cylinder forming the ejection bore 24*a* (d1/h1) must be 0.2 to 4.

Immediately after ejection, liquid surface vibrates to a relatively large extent, and the vibration remains. As a result, air (a bubble) is caught in the ejection nozzle 24 (particularly, an edge portion where the ceramic sheet is bonded) and then enters the pressurizing chamber 22, resulting in subsequent impairment in ejection stability. When the ratio (d1/h1) is not greater than 4, during ejection, contact resistance between liquid and the inside wall surface of the ejection bore 24*a* becomes relatively large, so that vibration remaining, on the liquid surface, immediately after ejection settles promptly. Accordingly, air's (a bubble's) being caught in the ejection nozzle 24 can be prevented, thereby preventing entry of a bubble into the pressurizing chamber 22 and thus enhancing ejection stability. On the other hand, when the ratio (d1/h1) is less than 0.2, during ejection, contact resistance between liquid and the inside wall surface of the ejection bore 24*a* becomes excessively large. As a result, the force of ejection becomes insufficient, resulting in ejection defect. Thus, a ratio (d1/h1) of 0.2–4 is preferred.

(3) The rate of change (per unit time) R in the ratio of the amount of change ΔV in the volume of the pressurizing chamber 22 to the sum (Vn+Vk) of the volume Vn of the ejection nozzle 24 and the volume Vk of the pressurizing chamber 22, (ΔV/(Vn+Vk)), must be 6 ppm/μs to 40 ppm/μs.

The rate of change R represents the ejection velocity of a droplet. Experiments revealed that the higher the ejection velocity (the greater the rate of change R), the smaller a liquid droplet becomes; and when the ejection velocity is excessively high (the rate of change R is in excess of 40 ppm/μs), ejection becomes unstable. The reason for such phenomena is, for example, as follows. Cavitation occurs within the ejection nozzle to thereby generate a bubble, which hinders stable ejection. Alternatively, after ejection, air (a bubble) is caught in the ejection nozzle 24 (ejection bore 24*a*) through the ejection opening, thereby disabling next ejection. When the ejection velocity is excessively low (the rate of change R is less than 6 ppm/μs), a droplet to be ejected tends to become granular. As a result, a single operation of pressurization causes ejection of merely a single liquid droplet. Thus, through determination of the ejection velocity as specified above, liquid is ejected stably in a mistlike form.

Table 1 shows the results of an experiment which was conducted to study ejection stability and whether or not liquid is ejected in a mistlike form, while the rate of change R was varied. In Table 1, the mark "○" appearing in the ejection stability column means that when the operation of pressurization was repeated continuously, a liquid droplet was able to be ejected in response to each operation of pressurization; and the mark "×" appearing in the ejection stability column means that a droplet was unable to be ejected in response to each operation of pressurization. The mark "○" appearing in the mistlike form column means that a plurality of liquid droplets were simultaneously ejected by means of a single operation of pressurization while the diameter of each liquid droplet was smaller than that of the ejection opening; and the mark "×" appearing in the mistlike form column means that ejection of liquid in a mistlike form failed. The expression "widened toward outlet" means the case of the first embodiment described above (i.e., the case where the inside diameter of the ejection bore 24*a* increases toward the ejection opening); the term "straight" means the case where the inside diameter is constant; and the expression "narrowed toward outlet" means the case where the inside diameter decreases toward the ejection opening. Liquid used in the experiment was CLENSOL having a viscosity of 0.82 mPa·S.

TABLE 1

(Experiment Data; Ejection Liquid: CLENSOL, Viscosity: 0.82 mPa · S)

| Sample No. | Dia. (d1) of ejection orifice / Height (h1) of ejection portion | $R = \frac{\Delta V}{Vn + VK}$ | Widened toward outlet | | Straight | | Narrowed toward outlet | |
|---|---|---|---|---|---|---|---|---|
| | | | Ejection stability | Mistlike form | Ejection stability | Mistlike form | Ejection stability | Mistlike form |
| 1 | 0.03 mm/0.075 mm | 80 (ppm/μsec) | × | ○ | ○ | ○ | ○ | ○ |
| 2 | ↑ | 20–40 | ○ | ○ | ○ | ○ | ○ | ○ |
| 3 | ↑ | 10–20 | ○ | ○ | ○ | × | ○ | × |
| 4 | ↑ | 6–10 | ○ | ○ | ○ | × | ○ | × |
| 5 | ↑ | 5 | ○ | × | ○ | × | × | × |

TABLE 1-continued (Experiment Data; Ejection Liquid: CLENSOL, Viscosity: 0.82 mPa · S)

| Sample No. | Dia. (d1) of ejection orifice / Height (h1) of ejection portion | $R = \frac{\Delta V}{Vn + VK}$ | Widened toward outlet | | Straight | | Narrowed toward outlet | |
|---|---|---|---|---|---|---|---|---|
| | | | Ejection stability | Mistlike form | Ejection stability | Mistlike form | Ejection stability | Mistlike form |
| 6 | ↑ | 4 | × | × | × | × | × | × |

As understood from the Table, a rate of change R of 6–40 ppm/μm is preferred.

(4) A value obtained by dividing, by the height h1 of the hollow cylinder, the difference (d1–d2) between the diameter d1 of the bottom face of the hollow cylinder forming the ejection bore 24*a* and the diameter d2 of the top face of the hollow cylinder, ((d1–d2)/h1), must be 0.05 to 0.7.

When the ratio ((d1–d2)/h1) is excessively large, a force imposed on liquid along the axial direction of the hollow cylinder forming the ejection bore 24*a* (i.e., along the direction perpendicular to the ejection opening) becomes excessively small, resulting in impairment in ejection stability. When the ratio ((d1–d2)/h1) is excessively small, a force imposed on the liquid along a direction perpendicular to the axial direction becomes excessively small; as a result, the ejected liquid becomes unlikely to assume a mistlike form. Thus, the ratio of 0.05–0.7 is preferred.

Second Embodiment

Figure 3A:
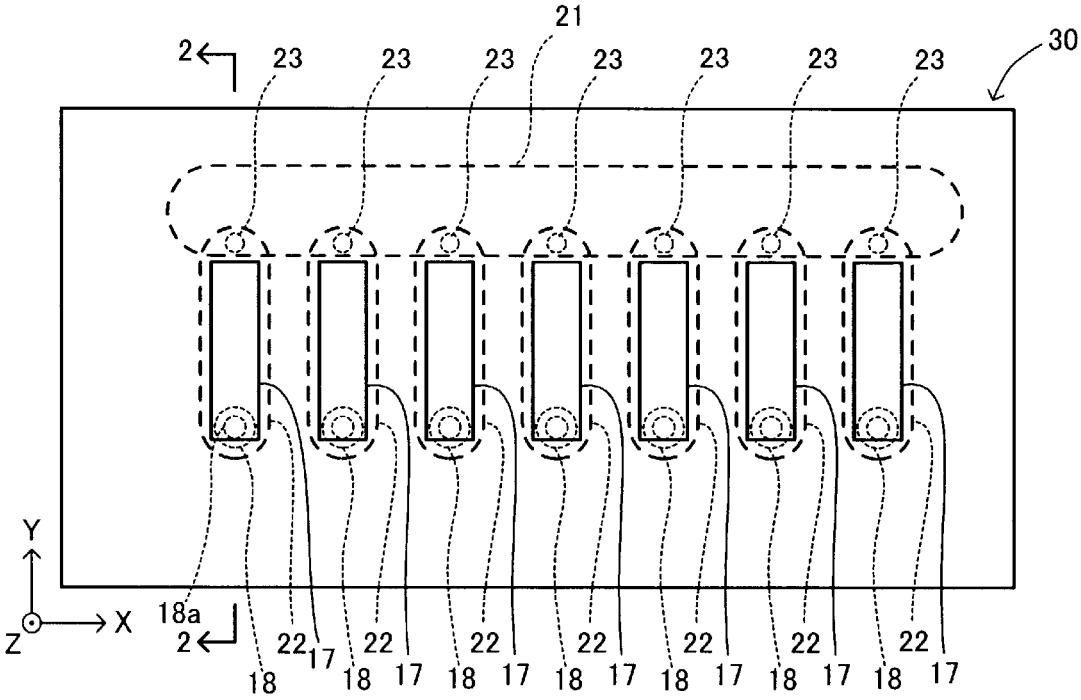
FIG. 3A is a plan view of a liquid droplet ejection apparatus according to a second embodiment of the present invention.
Figure 3B:
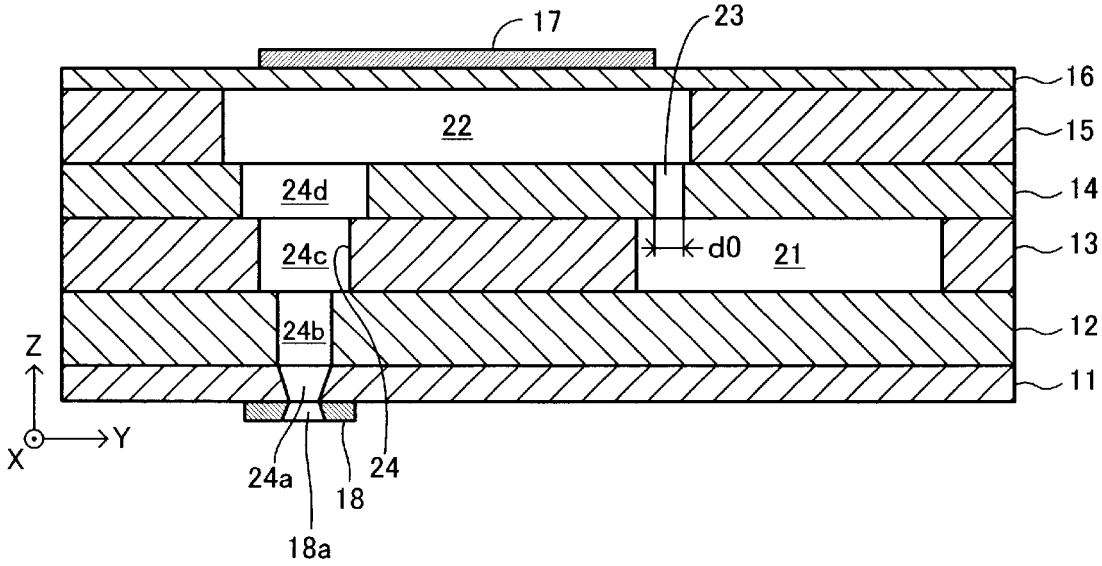
FIG. 3B is a sectional view of the liquid droplet ejection apparatus taken along line 2—2 of FIG. 3A.

Next, a second embodiment of a liquid droplet ejection apparatus of the present invention will be described. FIG. 3A is a plan view of a liquid droplet ejection apparatus 30 according to the second embodiment of the present invention. FIG. 3B is a sectional view of the liquid droplet ejection apparatus 30 taken along line 2—2 of FIG. 3A. The liquid droplet ejection apparatus 30 differs from the liquid droplet ejection apparatus 10 of the first embodiment merely in that a plurality of liquid-repellent layers 18 are formed on the outer side (lower side) of the ceramic sheet 11. Accordingly, this difference will be described below.

Each liquid-repellent layer 18 is made of a fluorine-containing resin and assumes a ring-like form formed around the opening of the ejection side of the corresponding through-bore 24*a*. Specifically, the liquid-repellent layer 18 has a hollow, substantially cylindrical ejection bore formed therein, and the bottom face of the hollow cylinder forms an ejection opening. In the second embodiment, the through-bore 24*a* is called a first ejection bore 24*a*, and the ejection bore formed in the liquid-repellent layer 18 is called a second ejection bore 18*a*.

Figure 4A:
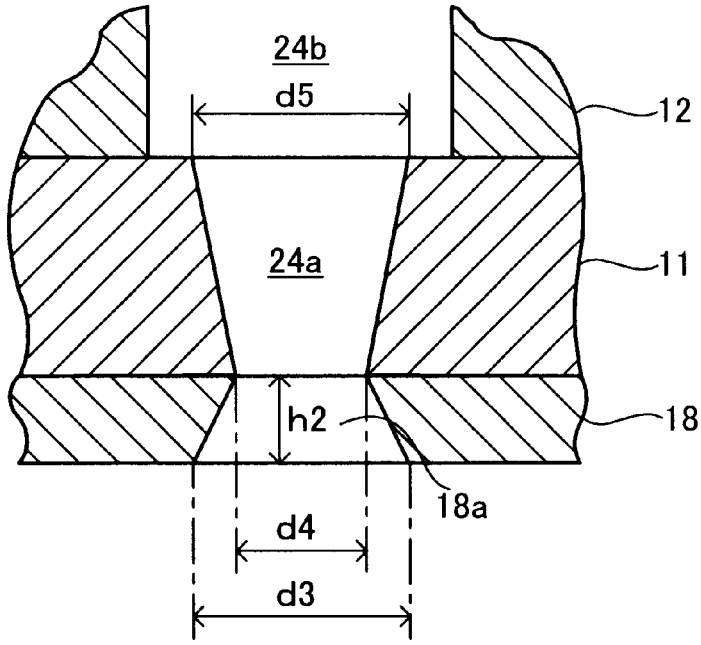
FIG. 4A is an enlarged sectional view of an ejection bore of the liquid droplet ejection apparatus shown in FIG. 3B.
Figure 4B:
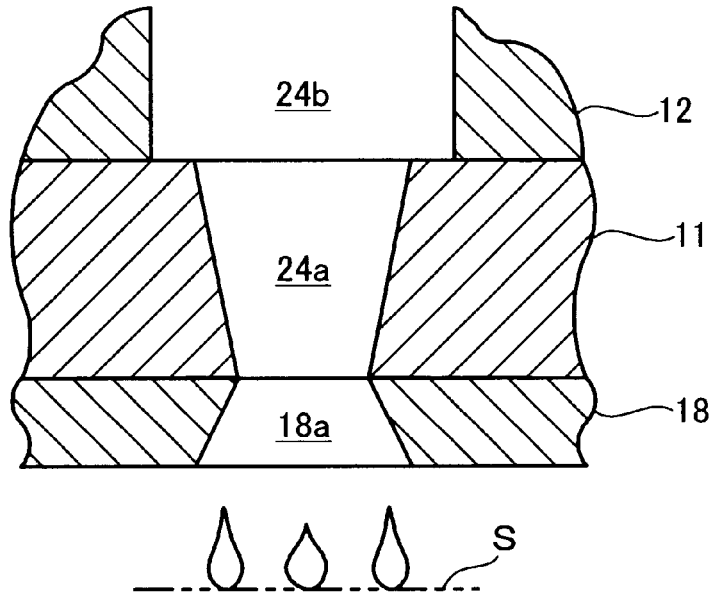
FIG. 4B is a view showing a state immediately after ejection of liquid droplets from the ejection bore shown in FIG. 4A.

FIGS. 4A and 4B are enlarged sectional views of the first and second ejection bores 24*a* and 18*a*. The first ejection bore 24*a* assumes a hollow, substantially cylindrical form such that the inside diameter thereof decreases toward the second ejection bore 18*a*. The second ejection bore 18*a* is formed such that the inside diameter thereof increases toward the ejection opening. That is, the relationships d3>d4 and d5>d4 are established, where d3 is the diameter of the ejection opening of the second ejection bore 18*a*, d4 is the diameter of the opening where the first ejection bore 24*a* and the second ejection bore 18*a* are connected, and d5 is the diameter of the first ejection bore 24*a* as measured on the side of the through-bore 24*b* (pressurizing chamber 22).

The thus-configured liquid droplet ejection apparatus 30 operates as does the liquid droplet ejection apparatus 10 described above. As shown in FIG. 4B, the inside diameter of the second ejection bore 18*a* increases toward the ejection opening. Thus, a single operation of pressurization induced by the piezoelectric/electrostrictive element 17 causes simultaneous ejection of a plurality of liquid droplets from the ejection opening; the diameter of the largest liquid droplet among liquid droplets ejected is not greater than the diameter d3 of the ejection opening; and the ejected liquid droplets simultaneously reach the imaginary plane S formed in such a manner as to maintain an equal distance to the ejection opening.

A plurality of liquid droplets are simultaneously ejected by means of a single operation of pressurization for the same reason as that in the case of the liquid droplet ejection apparatus 10. Additionally, since the liquid droplet ejection apparatus 30 has the liquid-repellent layer 18 formed around the ejection opening, an ejected liquid droplet is unlikely to adhere to an area around the ejection opening. Also, since the size of the liquid-repellent layer 18 is limited, a liquid droplet adhering to the liquid-repellent layer 18 does not grow to an excessively large size. Thus, ejection of liquid is not hindered. Furthermore, since the inside diameter of the first ejection bore 24*a* decreases toward the second ejection bore 18*a*, variation of liquid pressure within the pressurizing chamber 22 immediately after ejection is unlikely to occur, thereby lowering the possibility of entry of a bubble into the pressurizing chamber 22 from the ejection nozzle 24 immediately after ejection.

In this case, in order to simultaneously eject a plurality of liquid droplets, in addition to the requirements (1)–(3) described above, it is preferable that the following requirement (5) is satisfied.

(5) A value obtained by dividing, by the height h2 of the second ejection bore 18*a*, the difference (d3–d4) between the diameter d3 of the ejection opening of the second ejection bore 18*a* and the diameter d4 of the opening of the second ejection bore 18*a* a connected to the first ejection bore 24*a*, ((d3–d4)/h2), must be 0.5 to 2.0.

When the ratio ((d3–d4)/h2) is excessively large, a force imposed on liquid along the axial direction of the hollow cylinder forming the second ejection bore 18*a* (i.e., along the direction perpendicular to the ejection opening) becomes excessively small, resulting in impairment in ejection stability. When the ratio ((d3–d4)/h2) is excessively small, a force imposed on the liquid along a direction perpendicular to the axial direction becomes excessively small; as a result, the ejected liquid becomes unlikely to assume a mistlike form. Thus, a ratio ((d3–d4)/h2) of 0.5–2.0 is preferred.

Third Embodiment

Next, a third embodiment of a liquid droplet ejection apparatus of the present invention will be described. This liquid droplet ejection apparatus differs from the liquid droplet ejection apparatus 10 of the first embodiment merely in that a plurality of protrusion portions for accelerating ejection of liquid in a mistlike form are formed on the inside wall of the ejection bore 24*a*.

Figure 5A:
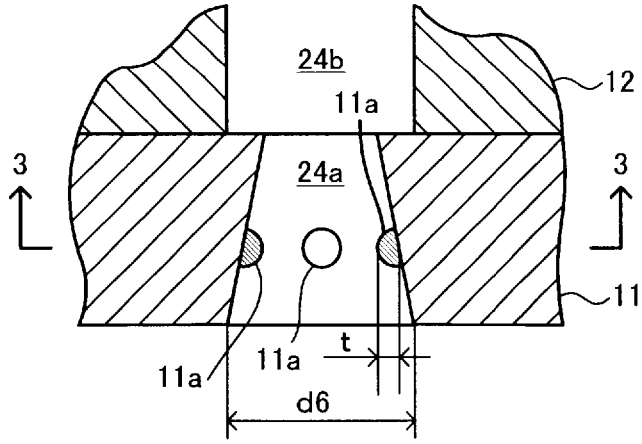
FIG. 5A is an enlarged sectional view of an ejection bore of a liquid droplet ejection apparatus according to a third embodiment of the present invention.
Figure 5B:
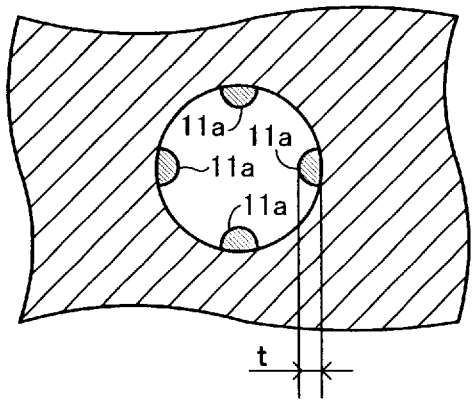
FIG. 5B is a sectional view of the ejection bore taken along line 3—3 of FIG. 5A.

The liquid droplet ejection apparatus according to the third embodiment will next be described in detail with reference to FIG. 5A, which is an enlarged sectional view of the ejection bore 24*a*, and FIG. 5B, which is a sectional view of the ejection bore 24*a* taken along line 3—3 of FIG. 5A. Specifically, four substantially hemispheric protrusion portions 11*a* each having a height t are formed on the inside wall of the ejection bore 24*a*. These protrusion portions 11*a* are circumferentially disposed in a substantially equally spaced condition while a substantially constant distance is established to the ejection opening.

In the liquid droplet ejection apparatus according to the third embodiment, the protrusion portions 11*a* spit liquid while the liquid passes through the ejection bore 24*a* (i.e., immediately before ejection); thus, the liquid is ejected in a further mistlike form.

In this case, preferably, the ratio of the height t of the protrusion portion to the diameter d6 of the ejection bore 24*a* (t/d6) is 0.03 to 0.17.

Figure 5C:
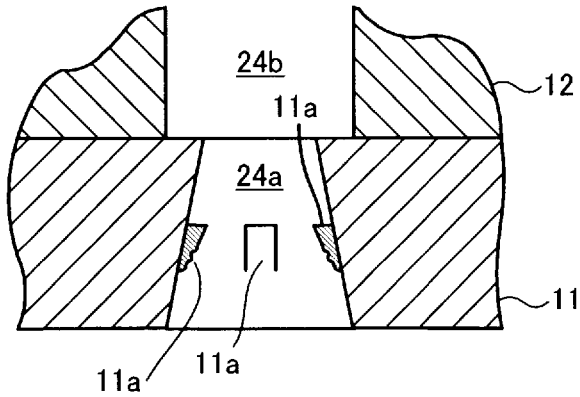
FIG. 5C is a sectional view of an ejection bore showing another example of protrusion portions of the third embodiment.
Figure 6:
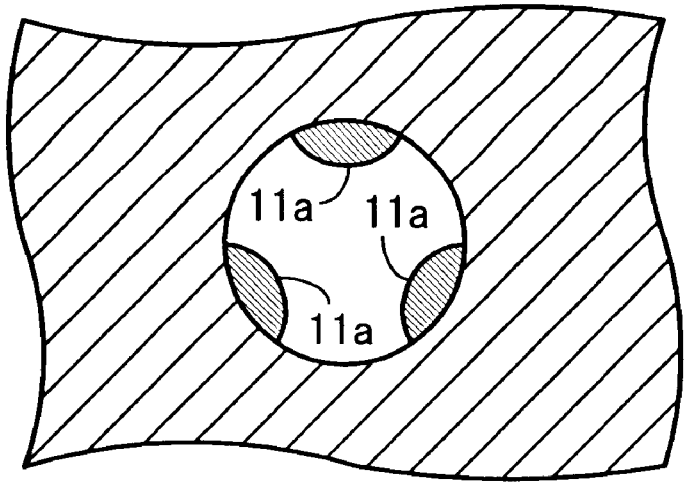
FIG. 6 is an enlarged sectional view of an ejection bore of a liquid droplet ejection apparatus according to a modification of the third embodiment of the present invention taken along a line similar to line 3—3 of FIG. 5A.

The protrusion portion 11*a* is substantially hemispheric but may assume another shape so long as liquid to be ejected can be effectively split. For example, the protrusion portion 11*a* may be formed such that a cross-sectional area thereof decreases toward the ejection opening, as in the case of FIG. 5C in which a cross section thereof is substantially triangular. Also, the protrusion portion 11*a* may assume the form of a triangle or quadrilateral as viewed from the ejection opening (i.e., as viewed from the bottom side). The number of protrusion portions may be 3 as shown in FIG. 6 to 12.

Preferably, the ejection bore 24*a* having the protrusion portions (protrusions) 11*a* is formed in the ceramic sheet 11 according to the following steps.

Figure 7:
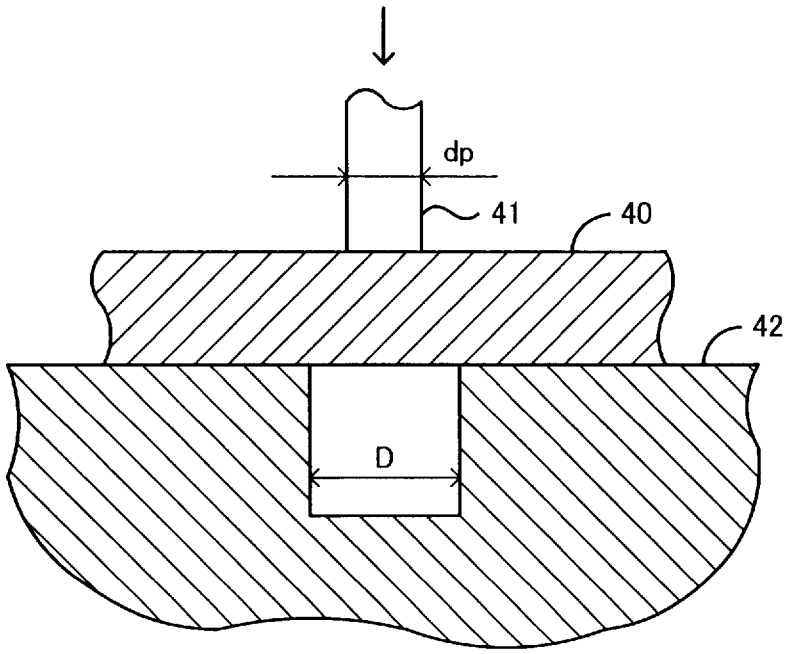
FIG. 7 is a view for explaining a method for manufacturing the ejection bore of the liquid droplet ejection apparatus according to the third embodiment.

1: A ceramic green sheet is formed by use of zirconia powder having a grain size of 0.1 to several $\mu$m; and 2: As shown in FIG. 7, the ceramic green sheet 40 (which will become the ceramic sheet 11 later) is subjected to punching by use of a punch 41 and a die 42, to thereby form the ejection bore 24*a*.

The diameter dp of the punch 41 is equal to the diameter d2 of the top face of the hollow cylindrical ejection bore 24*a* to be formed. The diameter D of the die 42 is greater than the diameter dp of the punch 41. The difference between the diameter D of the die and the diameter dp of the punch (i.e., clearance between the punch 41 and the die 42) (D−dp) is not greater than 0.04 mm, preferably not greater than 0.02 mm.

Each of the above-described liquid droplet ejection apparatuses of the present invention simultaneously eject a plurality of liquid droplets from the ejection opening by means of a single operation of pressurization effected by the piezoelectric/electrostrictive element 17 and is thus favorably applicable to, for example, a fuel injection apparatus which must inject fuel in the form of mist. The above-described liquid droplet apparatuses can be easily manufactured since at least the liquid supply path, the pressurizing chamber, and the ejection nozzle are integrally formed from zirconia ceramics. Also, by virtue of characteristics of zirconia ceramics, the liquid droplet ejection apparatuses exhibit high durability against frequent deformation (frequent operation of pressurization).

Figure 8:
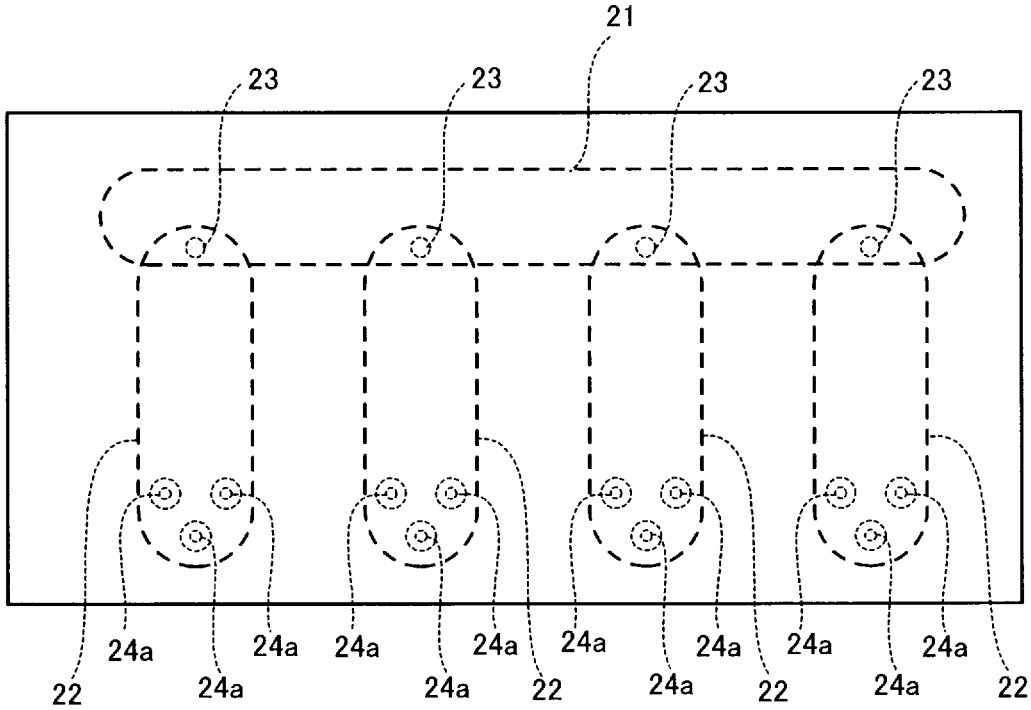
FIG. 8 is a plan view of a liquid droplet ejection apparatus according to another modified embodiment of the present invention.

While the present invention has been described with reference to the embodiments described above, it will be apparent to those skilled in the art that the present invention is not limited thereto, but may be modified in various forms within the scope of the present invention. For example, as in the case of a liquid droplet ejection apparatus whose plan view is shown in FIG. 8, a plurality of ejection bores 24*a* may be provided for a single pressurizing chamber 22. Also, a common piezoelectric/electrostrictive element 17 (a single element) may be provided for a plurality of pressurizing chambers so long as liquid pressure within the pressurizing chambers can be increased. Furthermore, the first and second ejection bores 24*a* and 18*a* of the liquid droplet ejection apparatus of the second embodiment may be provided with the protrusion portions 11*a* of the third embodiment.

What is claimed is:

1. A liquid droplet ejection apparatus comprising:

a pressurizing chamber communicating with a liquid supply path via a liquid introduction bore;

an ejection nozzle connected to said pressurizing chamber, said ejection nozzle having a circular ejection opening; and means for changing a volume of said pressurizing chamber so as to pressurize liquid introduced into said pressurizing chamber via said liquid introduction bore to thereby eject said liquid as liquid droplets from said ejection opening of said ejection nozzle, said means comprising a piezoelectric/electrostrictive element;

wherein a diameter of a largest liquid droplet among said ejected liquid droplets is not greater than a diameter of said ejection opening; and wherein said liquid droplet ejection apparatus comprises a plurality of members laminated to each other, a first of said members having an opening extending therethrough which defines said pressurizing chamber, a second of said members having second and third openings extending therethrough, wherein said second opening is spaced from said third opening and wherein said second and third openings are in communication with said pressurizing chamber, a third of said members having fourth and fifth openings extending therethrough, wherein said fourth opening is spaced from said fifth opening and wherein said fourth opening communicates with said second opening and said fifth opening communicates with said third opening, said fifth opening defining said liquid supply path, and a fourth of said members having a sixth opening passing therethrough, said sixth opening communicating with said fourth opening, an end of said sixth opening defining an ejection opening of said ejection nozzle.

2. The liquid droplet ejection apparatus of claim 1, wherein said sixth opening is substantially cylindrical.

3. The liquid droplet ejection apparatus of claim 1, wherein an inside diameter of said cylinder increases toward said ejection opening.

4. The liquid droplet ejection apparatus of claim 1, wherein said pressurizing chamber is positioned between said piezoelectric/electrostrictive element and said ejection nozzle, whereby actuation of said piezoelectric/electrostrictive element causes the pressure of said pressurizing chamber to increase, which in turn causes said liquid to be ejected from said nozzle.

* * * * *